United States Patent [19]

Hiroki et al.

[11] Patent Number: 4,856,768

[45] Date of Patent: Aug. 15, 1989

[54] SEPARATING DEVICE FOR A SHEET COLLECTION APPARATUS

[75] Inventors: Hisayuki Hiroki, Tokyo; Yoshio Ariga; Hajime Watanabe, both of Yokohama, all of Japan

[73] Assignee: Kabushiki Kaisha Toshiba, Kanagawa, Japan

[21] Appl. No.: 59,506

[22] Filed: Jun. 8, 1987

[30] Foreign Application Priority Data

Jun. 9, 1986 [JP] Japan ..... 61-133202

[51] Int. Cl.[4] ..... B65H 29/00; B65H 29/38

[52] U.S. Cl. ..... 271/186; 271/189; 271/218; 209/534; 209/551; 414/790.3; 414/790.8; 414/924

[58] Field of Search ..... 271/69, 184, 185, 186, 271/218, 225, 303, 306, 189; 209/534, 551; 194/206, 207; 414/50; 235/379

[56] References Cited

U.S. PATENT DOCUMENTS

| | | | |
|---|---|---|---|
| 3,539,055 | 11/1970 | Blansko | 271/189 X |
| 4,214,743 | 7/1980 | Meier | 271/184 X |
| 4,365,700 | 12/1982 | Arimoto et al. | 194/206 |
| 4,465,192 | 8/1984 | Ohba et al. | 209/534 |
| 4,681,229 | 7/1987 | Uesaka et al. | 209/534 |

FOREIGN PATENT DOCUMENTS

| | | | |
|---|---|---|---|
| 0109743 | 5/1984 | European Pat. Off. | 209/534 |
| 3414519 | 6/1985 | Fed. Rep. of Germany | 194/206 |
| 0081051 | 5/1982 | Japan | 271/186 |

*Primary Examiner*—Joseph J. Rolla
*Assistant Examiner*—Edward S. Ammeen
*Attorney, Agent, or Firm*—Finnegan, Henderson, Farabow, Garrett and Dunner

[57] ABSTRACT

A separating device for a sheet collection apparatus including support arms for interrupting the passage of sheets between the obverse and reverse convey path outlets and the collecting portion of the sheet collection device after a designated number of sheets have entered the collection device. The separating arms are individually movable for interacting and supporting conveyed sheets for a predetermined period of time while the sheets in the collection device are being bundled. The support arms rotate from a neutral position to a primary support position between the obverse and reverse convey path outlets and the collection device. The support arms also rotate to a secondary support position at specified intervals for facilitating the passage of sheets from the obverse and reverse convey path outlets on to the separating device.

5 Claims, 11 Drawing Sheets

SEPARATING DEVICE FOR A SHEET COLLECTION APPARATUS

BACKGROUND OF THE INVENTION

This invention relates to a sheet collecting device for collecting and aligning the sides of sheets, such as bills or banknotes with randomly mixed obverse and reverse sides.

A sheet sorter/stacker has been developed as a sheet collecting apparatus wherein sheets such as bills or bank notes, including various denominations, are inspected and sorted/counted in accordance with the inspection results in one continous operation.

In the bank note sorter/stacker of this type, the banknotes include a mixture of obverse and reverse notes, which are placed into an input section and are fed one by one to an inspection unit by a take out device. After inspection of the denomination and the like, the notes are collected separately according to the results of the inspection. At the same time, if required, the banknotes are collected separately in designated numbers, and the sides of the banknotes are aligned. The notes are then sealed into bundles of the designated numbers.

In a prior system, banknotes are taken out one by one from an input section and sensed with respect to denomination, etc. Then, they are sorted with all obverse or reverse sides facing in the same direction through either a straight path or switchback path according to the sensing result. Then in the next stage, the notes are divided and collected at a collecter having a separater attached for separation into specified numbers of notes.

However, when using this type of prior art system, space has to be provided for a front path and a back path in order to orient bills with the obverse and reverse sides facing in the same directions. This results in the inconvenience of the unit becoming bulky. Another prior art device is disclosed in U.S. Pat. No. 4,470,590 owned by the same assignee as the present invention. In that device, a rotating blade wheel and a rotating sectional stacking member are used to separate the notes into a predetermined plurality of notes. However, with this structure, notes may become disoriented in the space between adjacent blades, resulting in improper operation. Also, this arrangment requires a relatively large amount of space in the collecting device.

SUMMARY OF THE INVENTION

Accordingly, it is a primary object of the present invention to reduce the size of a sheet collecting device, particularly the stacking and separating portions thereof.

It is another object of the invention to efficiently separate and stack sheets in predetermined pluralities.

Additional objects and advantages will be obvious from the decription which follows, or may be learned by practice of the invention.

The objects of the invention are achieved by providing an improved sheet collecting device including means for detecting between the obverse or reverse side orientation of the conveyed sheet; obverse sheet convey means for conveying the sheets which are detected by the detecting means to have the obverse side orientation, the obverse sheet convey means having a first outlet; reverse sheet convey means for conveying the sheets which are detected by the detecting means to have the reverse side orientation, the reverse sheet convey means having a second outlet facing the first outlet; means for guiding the sheet to one of the obverse sheet convey means and reverse sheet convey means in response to the detecting means; means for collecting the sheet conveyed from both the obverse sheet convey means and the reverse sheet convey means; means for receiving predetermined pluralities of the sheets collected by the collecting means; and first and second separating means for interrupting the passage of sheets between the first and second outlets and the collecting means and being individually movable and interacting for supporting sheets for a predetermined time.

Figure 3:
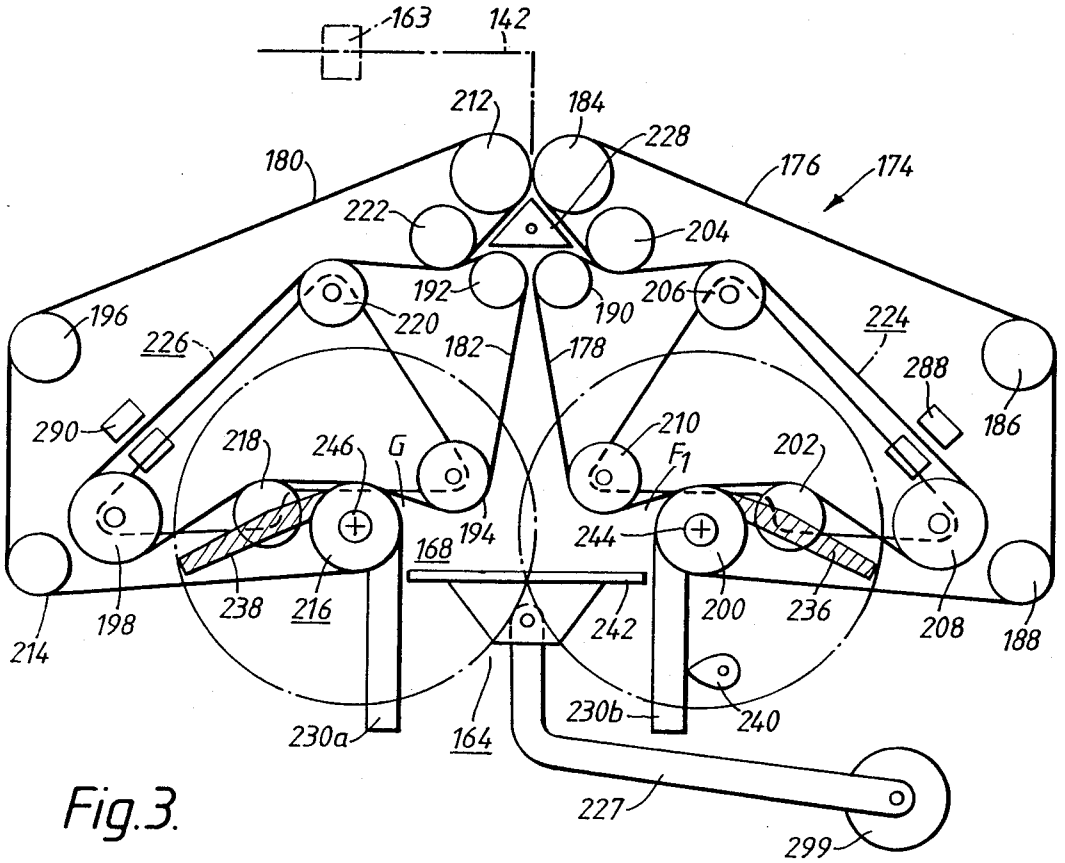
FIG. 3 is a schematic side view showing a portion around a collecting device of the note-sorting/bundling apparatus shown in FIG. 1.
Figure 4:
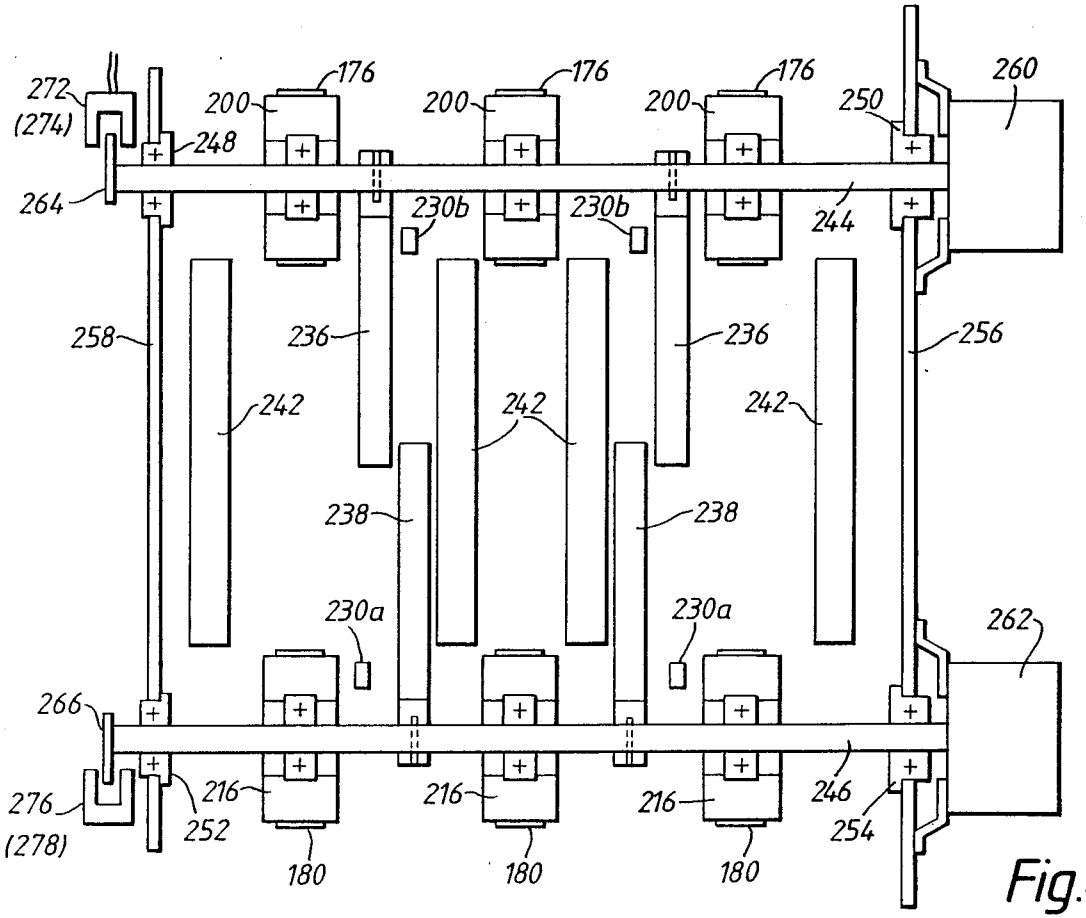
FIG. 4 is a plan view of the collector shown in FIG. 3.
Figure 7:
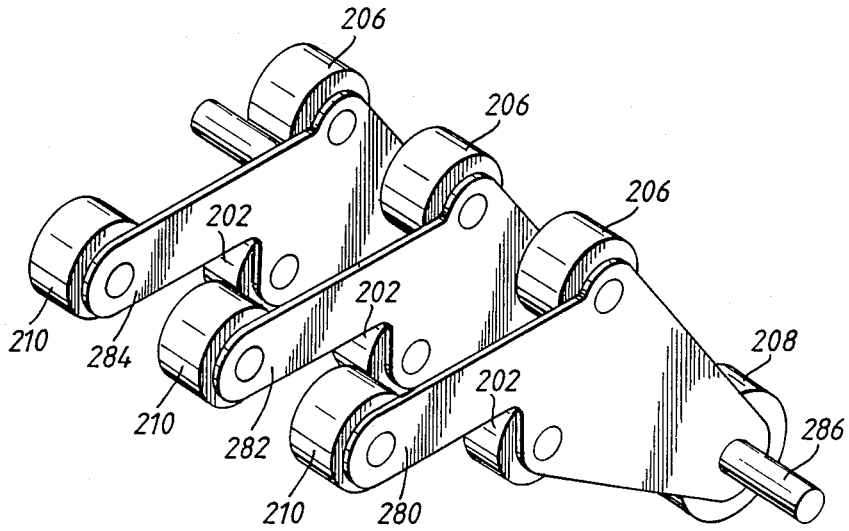
Figure 8:
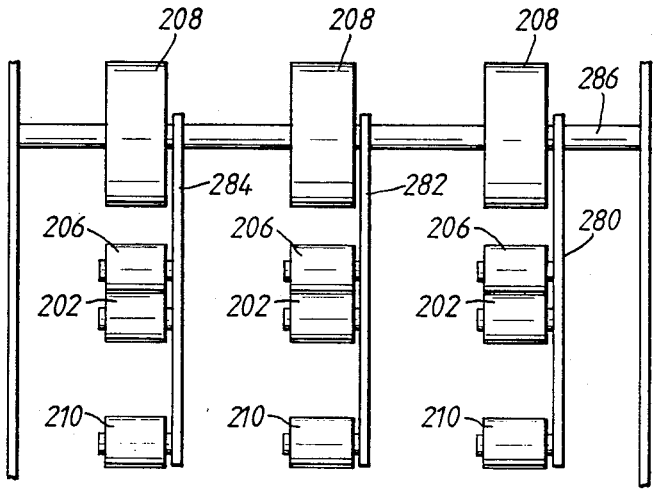
Figure 9:
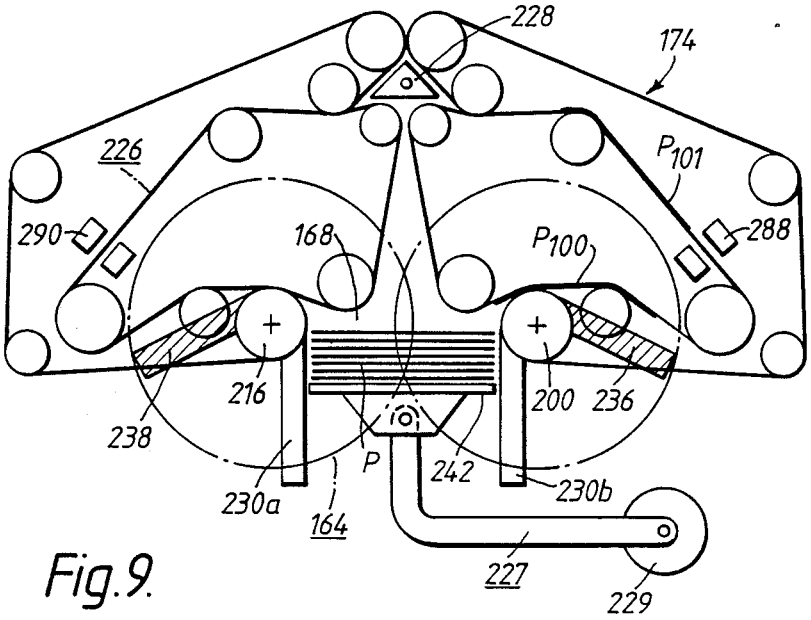
Figure 10:
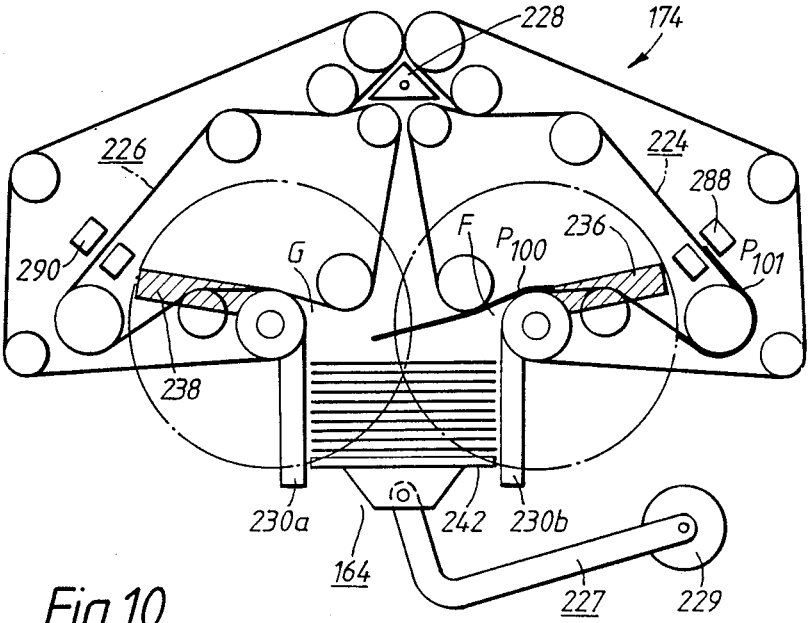
Figure 11:
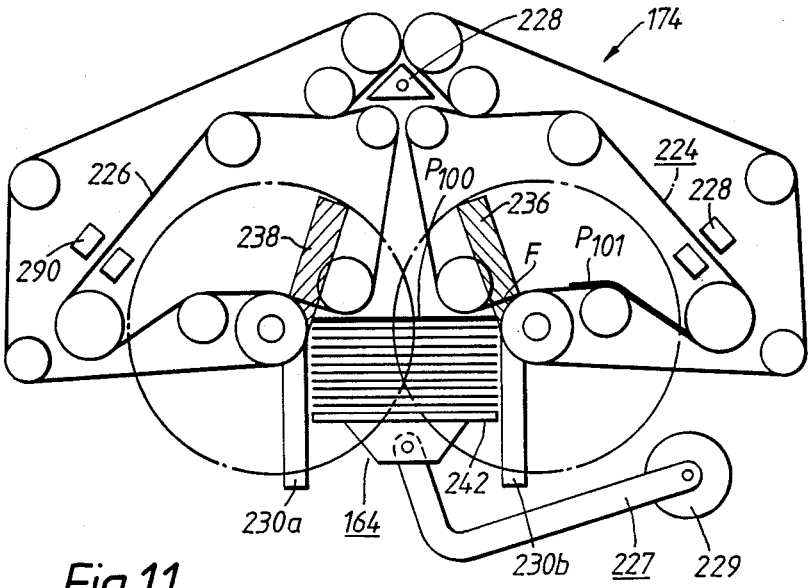
Figure 16:
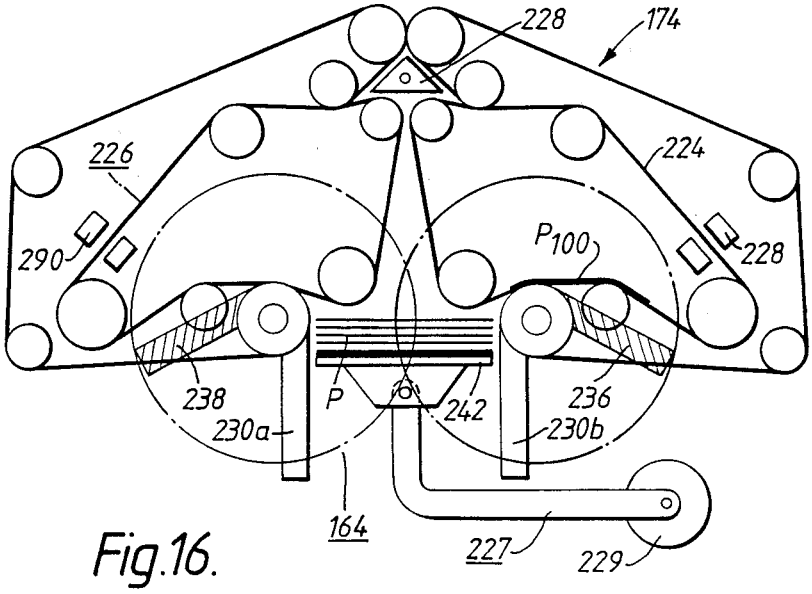
Figure 17:
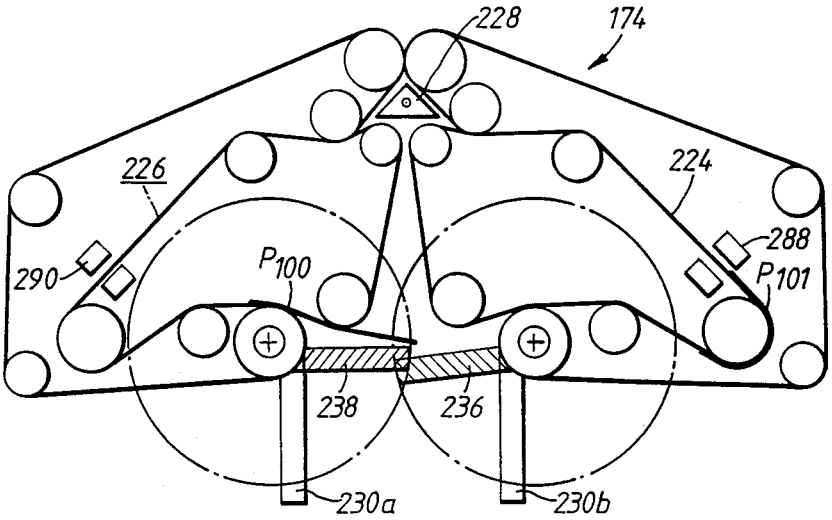
Figure 18:
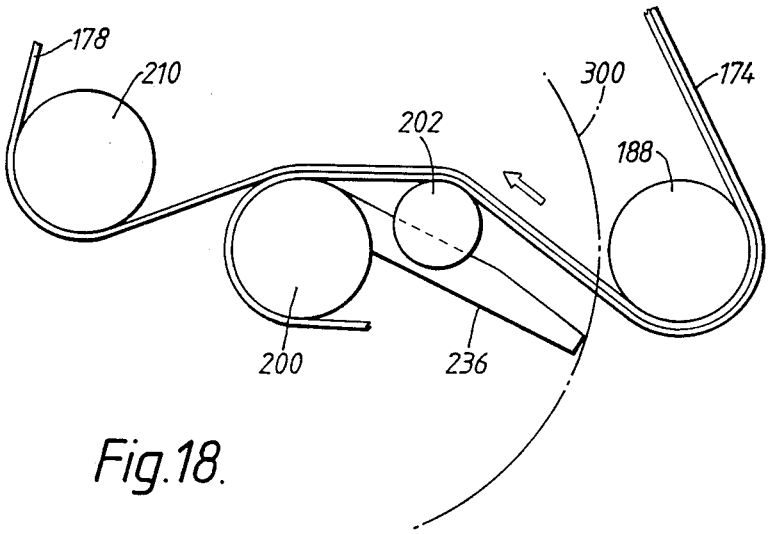

FIG. *6a* and *6b* are side views of the details of the essential part of the collector shown in FIGS. 3 and 4;

FIG. 7 illustrates a rotating roller supporting mechanism;

FIG. 8 is a plan view of the mechanism shown in FIG. 7;

FIG. 9 to FIG. 17 are side views showing a succession of steps in the separating of banknotes in the collector shown in FIG. 3; and FIG. 18 is a side view showing the starting position of the separator shown in FIG. 9.

DETAILED DESCRIPTION OF THE PREFERRED EMBODIMENTS

Embodiments of the present invention will now be described with reference to the accompanying drawings.

Figure 1:
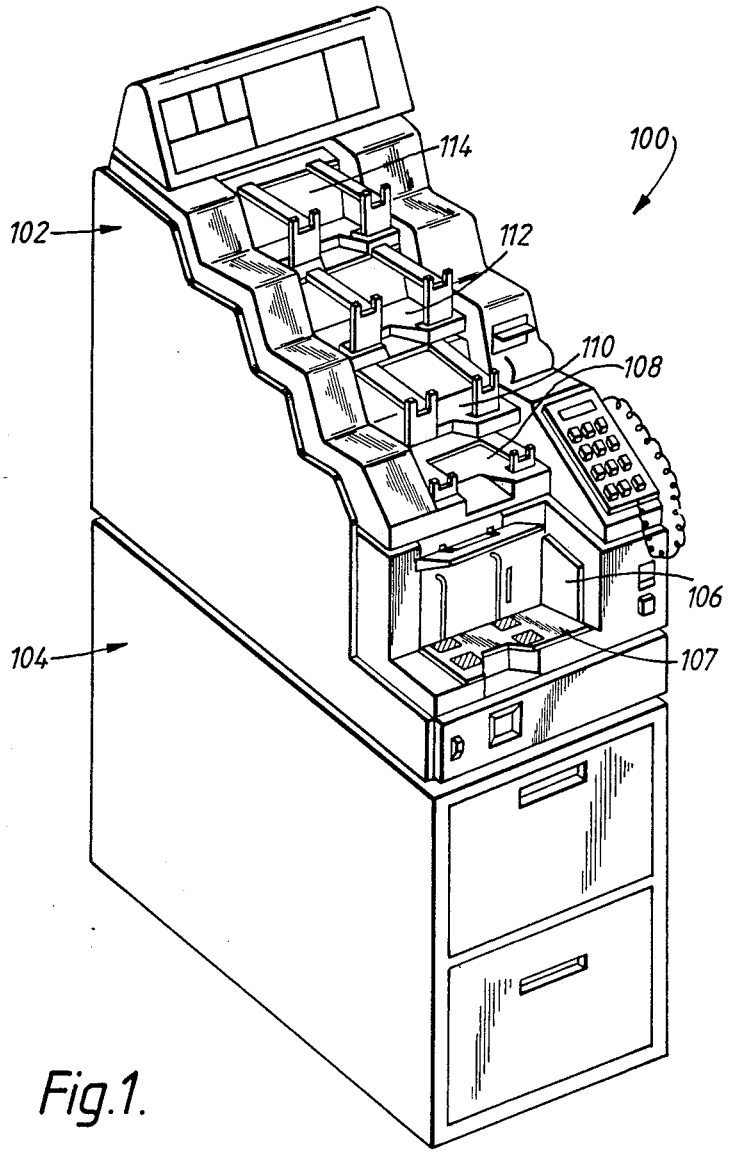
FIG. 1 is a schematic perspective view of a note-sorting/bundling apparatus constituting a sheet processing apparatus according to the present invention.

FIG. 1 shows an outer apparatus to which an embodiment of the sheet collecting device according to the present invention may be applied.

Note-sorting/bundling apparatus 100 has upper and lower housings 102 and 104. Upper housing 102 stores a note-sorting device. Lower housing 104 stores a note-bundling device. The upper surface of upper housing 102 is stepped. Banknote supplying portion 106, on which a mixture of banknotes of different denominations is placed, is provided on the upper surface of the lowermost step 107. First to fourth note-stackers 108, 110, 112 and 114 are provided on the remaining steps on the upper surface of upper housing 102 so as to stack a plurality of bank notes, sorted by the note-sorting device.

Figure 2:
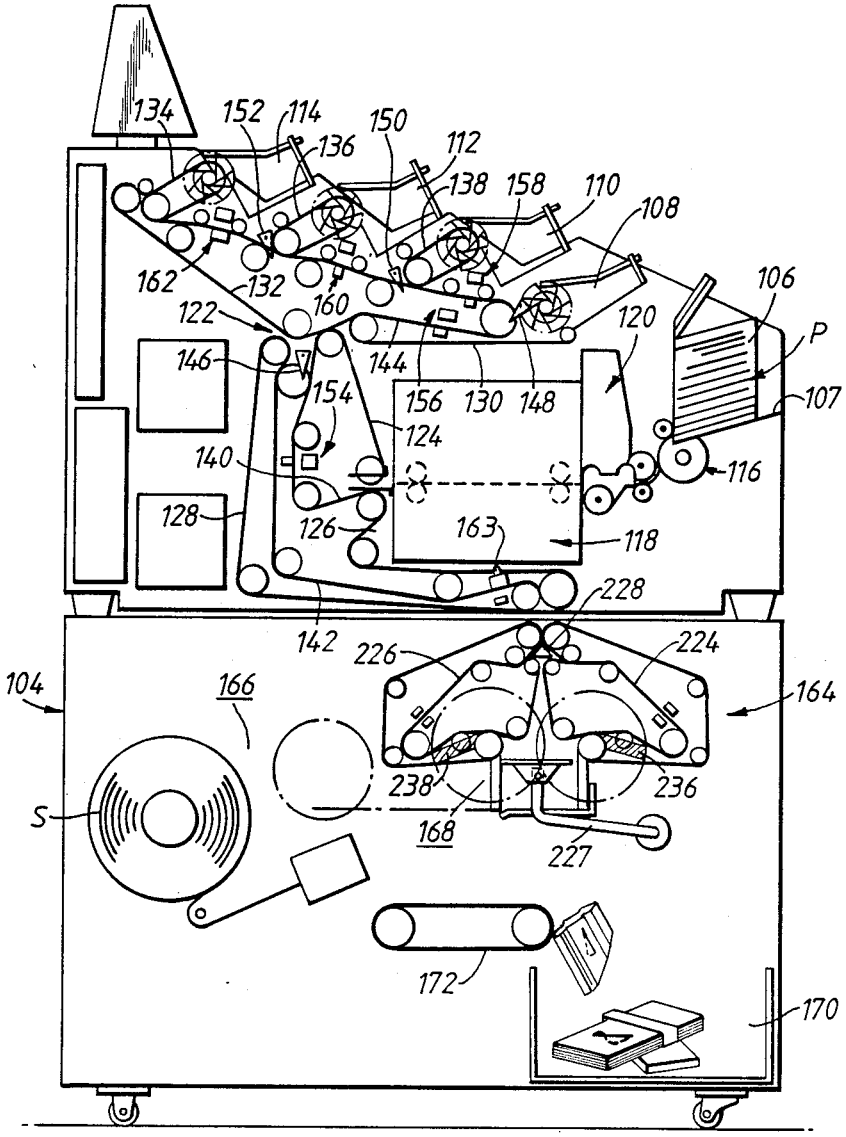
FIG. 2 is a schematic side view showing the interior of the upper and lower housings of the note-sorting-/bundling apparatus shown in FIG. 1.

FIG. 2 schematically shows the interior of upper and lower housings 102 and 104. The mixture of different denomination notes lies on note-supplying portion 106. Take-in device 116, is arranged under supplying portion 106. Take-in device 116 takes in bank notes one by one from supplying portion 106, and supplies each note to note-discriminating device 118 through thickness detector 120. Detector 120 detects whether two or more banknotes are taken in simultaneously by take-in device 116, and whether foreign matter, such as adhesive cellophane tape is adhered to a single note. Take-in device 116 and detector 120 have a convey path for conveying banknotes one by one from note-supplying portion 106 to discriminating device 118.

Discriminating device 118 discriminates the denomination (e.g., four denominations), authenticity, fit (usable)/unfit (unusable) condition (the extent of damage) and obverse/reverse orientation of the cnveyed banknote.

Convey device 122 has a combination of endless convey belts 124, 126, 128, 130, 132, 134, 136, and 138 and rotating rollers, around which these belts are wound. Convey device 122 is arranged at the outlet of discriminating device 118. Convey device 122 has a main convey path 140, second convey path 142 and sorting convey path 144. First to fourth note stackers 108, 110, 112 and 114, respectively, are located at ends of the sorting convey path 144. In this embodiment, first to fourt note stackers 108, 110, 112 and 114 stack reject notes, first kind of notes, second kind of notes, and third kind of notes, respectively.

First selector gate 146 is disposed at the terminal end of main convey path 140 to selectively guide a note which reaches gate 146 to one of second convey path 142 and sorting convey path 144. Selector gates 148, 150 and 152 are disposed at the branch portions of sorting convey path 144 to selectively guide a banknote to one of the first to fourth note stackers 108, 110, 112 and 114.

Optical detecting devices 154, 156, 158, 160 and 162 are also arranged on each of the convey paths immediately before a plurality of selector gates 146, 148, 150 and 152 and immediately before a branch point located at the end of each of the convey paths.

A plurality of selector gates 146, 148, 150 and 152 guide the bank note supplied from main convey path 140 to a corresponding convey path and an associated stacker in accordance with the discrimination results of discriminating device 118. These selector gates 146, 148, 150 and 152 are controlled by a control unit (not shown) connected to discriminating device 118, optical detecting devices 154, 156, 158, 160 and 162 and selector gates 146, 148, 150 and 152. Optical detecting device 163 is arranged at a point immediately before the end of second convey path 142.

Lower housing 104 has collecting device 164 and bundling device 166. Collecting device 164 collects a plurality of banknotes supplied from second convey path 142 one by one in collecting chamber 168. Hence, the obverse/reverse side of the banknotes stacked in collector chamber 168 are aligned on the same side. When the number of the banknotes stacked in collecting chamber 168 reaches a predetermined number (e.g., 100), the predetermined number of notes in collecting chamber 168 is supplied to bundling device 164. The predetermined number of banknotes is bundled by strip S and bundling device 166. Bundled banknotes are conveyed from the bundling position to note bundle stacker 170 by convey device 172 and are stacked there.

The note bundling device having the above arrangment is also disclosed in U.S. Pat. No. 4,483,124, owned by the same assignee as the present invention.

FIG. 3 is a schematic side view of a portion around collecting device 164. Collecting device 164 includes a combination of a plurality of endless convey belts 176, 178, 180 and 182 and rotating rollers 184, 186, 188, 190, 192, 194, 196, 198, 200, 202, 204, 206, 208, 210, 212, 214, 216, 218, 220 and 222, around which these belts are wound. Convey device 174 has an obverse convey path 224 and a reverse convey path 226. The inlets of obverse convey path 224 and reverse convey path 226 are opposite to the outlet of second convey path 142.

Obverse convey path 224 includes belts 176 and 178 which run facing each other over a number of rollers 204 to 222. Reverse convey path 226 includes belts 180 and 182 which run facing each other over a number of rollers 184 to 202.

Selector gate 228 is disposed at branch points of obverse convey path 224 and reverse convey path 226 to selectively guide a banknote to either the obverse convey path 224 or the reverse convey path 226;

Collecting chamber 168 includes a back up mechanism 227 and side wall 230*a* and 230*b*. Collecting chamber 168 is disposed between the outlets of obverse convey path 224 and reverse convey path 226 for collecting the sheets.

Back up mechanism 227 includes receiving platform 242 and pulse motor 229. Receiving platform 242 collects a specified number of banknotes thereon and vertically transfers them. The outlets F and G of obverse convey path 224 and reverse convey path 226 face each other on either side of collecting chamber 168.

That is to say, banknotes which are continuously conveyed one by one via second convey path 142 with mixed obverse and reverse sides, are passed through optical detecting device 163 provided on secnd convey path 142. Then they are guided by selector gate 228 according to the discrimination results of the discriminating device. Obverse convey path 224 conveys the banknotes which are detected by the discriminating device to have an obverse orientation. Reverse convey path 226 conveys the banknotes which are discriminated by the discriminating device to have a reverse orientation. As a result, the sides the banknotes are aligned in the same manner when the banknotes are collected in the collecting chamber 168.

Furthermore, in the vicinity of outlets F and G of obverse convey path 224 and reverse convey path 226, a dividing device is provided to divide a designated number of banknotes collected in collecting chamber 168 from the banknotes P which come after. As embodied herein, this dividing device has separators 236 and 238 which rotate to cross obverse convey path 224 and reverse convey path 226, respectively. The designated number of banknotes P which have been collected in collecting chamber 168 are divided from those banknotes which come after by rotating separators 236 and 238 after a designated number of banknotes which are conveyed from obverse convey path 224 and reverse convey path 226 have passed. The banknotes P which come after the designated number are received on separators 236 and 238.

Collecting chamber 168 is provided with positioning device 240, which positions the collected banknotes P by imparting vibration to back up mechanism 227. This alters the position of the receiving platform 242 in collecting chamber 168 and between the two side walls 230*a* and 230*b*.

Figure 5:
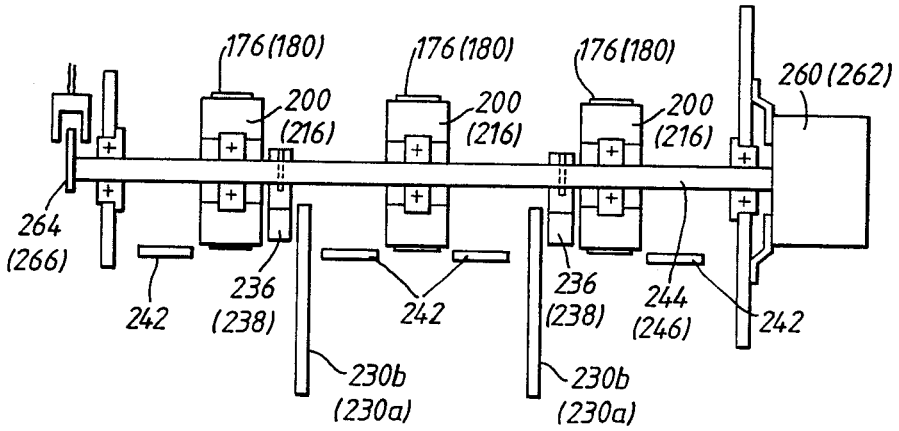
FIG. 5 is a side view of the collector shown in FIG. 3.

As shown in FIG. 4 and FIG. 5, convey device 174 has shaft 244 and 246, both ends of which are rotatably supported by bearings 248, 250, 252 and 254 attached to side frames 256 and 258. Separators 224 and 226 are fixed on shafts 244 and 246. Shafts 244 and 246 are free to rotate through roller bearings (not shown), which are at the open side immediately in front of the entrance to collecting chamber 168. Belts 176 and 178 are wound around the rollers. Shafts 244 and 246 are respectively driven in specified directions by pulse motor 260 and 262, i.e., in the same directions of banknotes P in the obverse convey path 224 and the reverse convey path 226.

At the end of shafts 244 and 246, there are provided timing disks 264 and 266. Timing disks 264 and 266 have detecting pieces 268 and 270 on the peripheral surface. Detecting pieces 268 and 270 are detected by detectors 272, 274, 276 and 278 disposed around timing disks 264 and 266. Detectors 272 and 276 detect the movement of the separators 236 and 238. Detectors 272 and 278 detect the horizontal position of the separators 236 and 238.

Figure 6A:
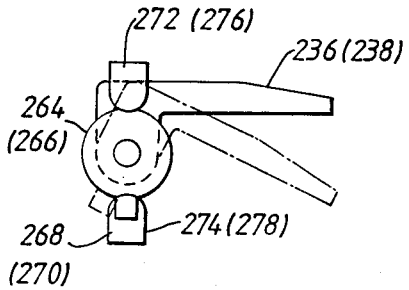
Figure 6B:
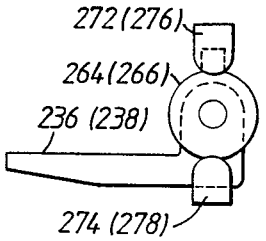

Before the separating operation, separators 236 and 238 are located in a waiting position indicated by a dot and dash line in FIG. 6*a*. When separators 236 and 238 move from the waiting position, detectors 272 and 276 detect the movement of the separators. When the separator has reached a predetermined angular position (horizontal position) for the separating operation, detectors 274 and 278 detect detecting pieces 270 and 274, as shown in FIG. 6*b*.

As shown in FIGS. 7 and 8, rollers 202, 206, 208, 210 installed on frames 280, 282 and 284 are free to rotate through the bearings of rollers (not shown). Frames 280, 282 and 284 are fixed on shaft 286, which is fixed on side frames 256 and 258. The rollers installed on each frame 280, 282 or 284 are free to rotate through the bearings of these rollers. Then separators 236 and 238 are moved between each of the rollers without interference.

Separators 236 and 238 are set to less than half of the external diameters of rollers 200 and 216 on whcih belts 174 and 180 are mounted. Furthermore, as shown in FIG. 6*b*, separators 236 and 238 are shaped so that, in the normal position after the separation position, they are thicker on the side opposite the incoming direction in order to guarantee space for the collection on one of the surfaces (the upper surfaces) of banknotes P which come after the specified number. Moreover, separators 236 and 238 have a certain thickness and form a positive level difference between banknotes P which come after the specified number and the specified number of banknotes P collected in collecting chamber 168. This eliminates the effect of static electricity on banknotes P which are in contact with separators 236 and 238 during separation.

The mutual orbits of rotation of the leading edges of separators 236 and 238 are designed to intersect at collecting chamber 168. At the same time, separators 236 and 238, receiving platform 242 and side walls 230*a* and 230*b* of collecting chamber 168 are formed to nest, so that they do not come into contact with each other.

Furthermore optical detectors 288 and 290 are arranged in obverse convey path 224 and reverse convey path 226. The leading edges (or the trailing edges) of banknotes P which are being conveyed are sensed by these detectors 288 and 290.

A counter (not shown) counts the number of banknotes by the detecting signal from both the detectors 288 and 290.

Next the operation of collecting device 164 is described with reference to FIGS. 9 to 18.

First, as described above, banknotes P which are put into supplying portion 106 with mixed obverse and reverse sides, are taken in one by one by the take-in device 116. They are conveyed to discriminating device 118 and then discriminated by denomination, fit/unfit and obverse/reverse. Then they are conveyed to main convey path 140. Designated denominations of banknotes P are guided to second convey path 140 by first selector gate 146.

Since banknotes P which arrive at optical detecting device 163 provided on the end of second convey path 142 (shift sensor) are controlled so that the obverse and reverse sides are shifted by a linking motion with the banknotes, selector gate 228 is controlled by signals from the detecter deivce 163, so as to selectively guide the banknotes to one of obverse convey path 224 and reverse convey path 226. Then, when a banknote P passes along obverse convey path 224, its passage is sensed by detecter 288. When a banknote P passes along reverse convey path 226, its passage is sensed by detecter 290. Every time banknotes pass, they are counted up by the counter.

In the initial stage, separators 236 and 238 are located at waiting positions immediately below obverse and reverse convey paths 224 and 226. At the same time, receiving platform 242 of back-up mechanism 227 is shifted by back-up control motor 229 so that it moves downward according to the amount of bills collected, and constantly takes up a position at a height where banknotes P coming into collecting chamber 168 can be easily received.

Figure 12:
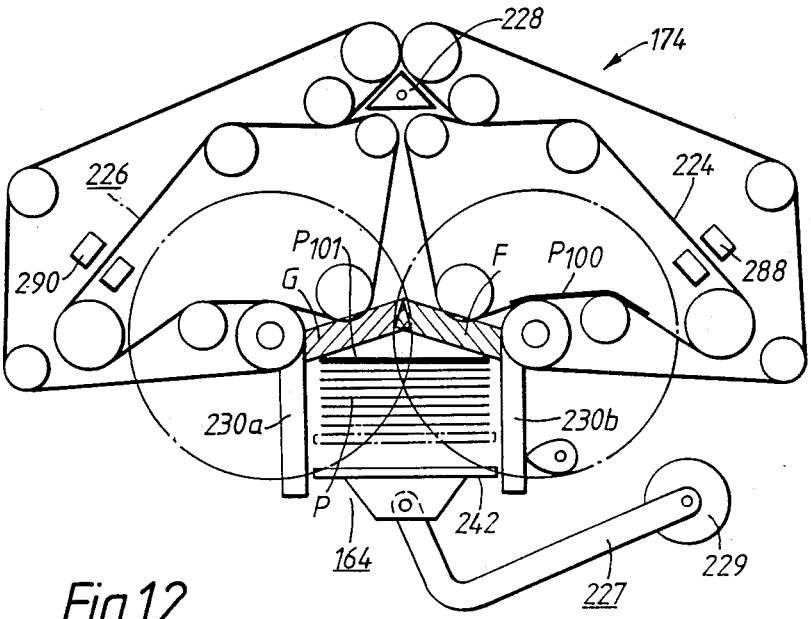

After the count value reaches the designated number, for example by banknote P100 which completes the designated number, and that note passes the position of detector 288, the next note P101 is conveyed to the position of detector 288 or 290, as shown in FIG. 9. Pulse motors 260 and 262 are started to drive at the same time, taking into account the operating time for separators 236 and 238. This controls the separators so that, as shown in FIG. 12, the tips of separators 236 and 238 come between banknote P100, which is the final note of the designated number, and banknote P101, which comes after the designated number.

Moreover, when separators 236 and 238 move from the waiting position, detectors 272 and 276 detect the movement of separators 236 and 238.

Figure 13:
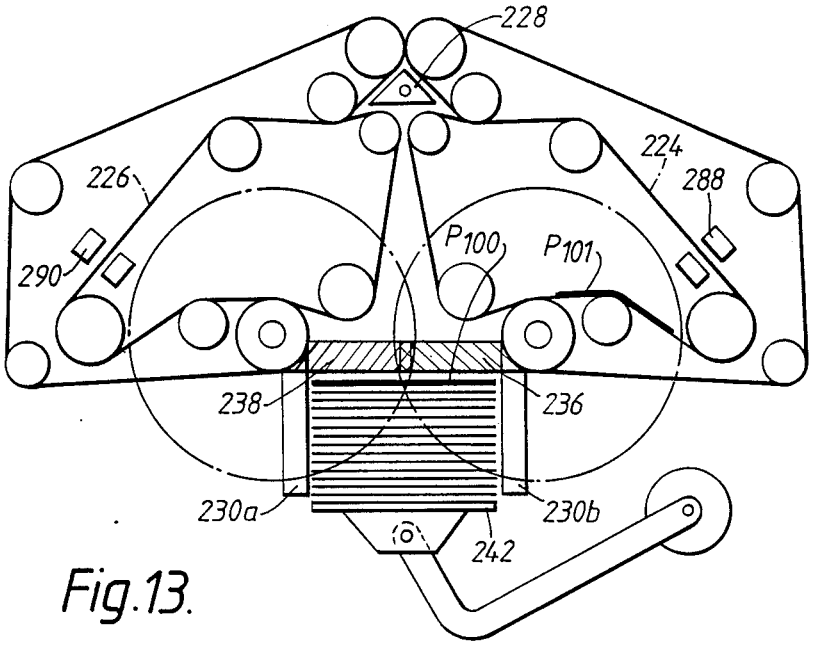

As shown in FIGS. 11 to 16, the tip of separator 236 successively rotates so that it does not touch the trailing edge of banknote P100, which completes the designated number. The separator 236 crosses convey path 224 and takes up a position which completely divides banknote P101 coming after the designated number. Separators 236 and 238 are stopped after being driven for a predetermined operating time, as shown in FIG. 13. When separators 236 and 238 have reached the predetermined angular position (horizontal position) for the separating operation, detectors 274 and 278 detect detecting pieces 270 and 274.

Banknote P101, which comes after the designated number, and banknots P, which follow banknote P101, are temporarily stored by separators 236 and 238.

When banknote P101 is collected by separators 236 and 238, a level difference is provided at the tips of separators 236 and 238, depending on whether banknote P101 is conveyed by the obverse convey path 224 or by the reverse convey path 226, so that the edge of the incoming banknote P is not crushed.

Figure 14:
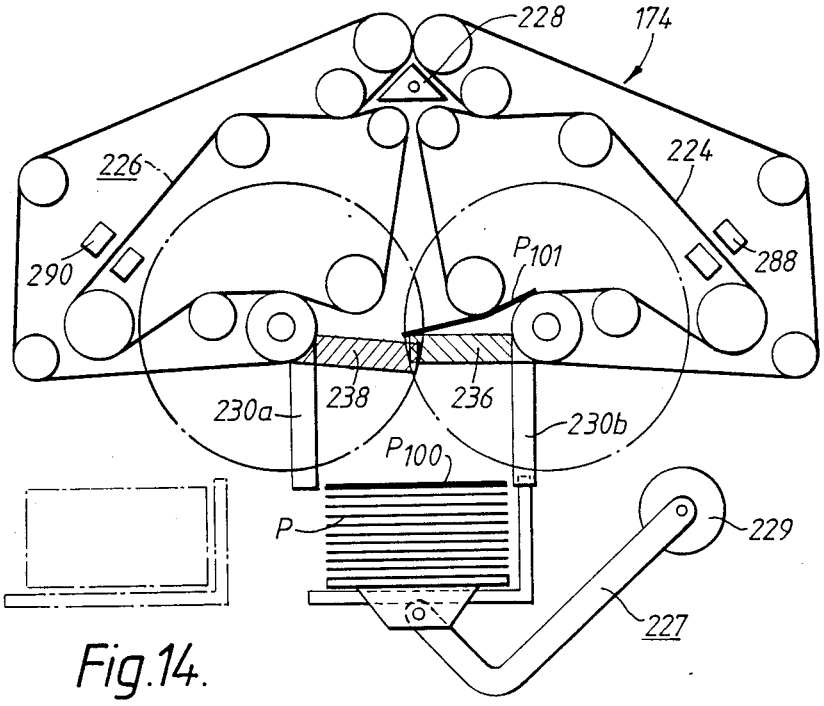

That is to say, when banknote P101 is conveyed by obverse convey path 224 as shown in FIG. 14, the pulse motor 262 drives separator 238 downward. Then, the tip of separator 238 is placed slightly below the tip of separator 236 in response to a signal form detector 288.

Thus, when banknote P101 comes in, it cannot possibly be crushed on the tip of separator 238. Moreover, in the reverse case, when banknote P101 which comes by the reverse convey path 226, as shown in FIG. 17, the pulse motor 260 drives the separator 236 downward, and then the tip of separator 236 is placed slightly below the tip of separator 238 in response to a signal from detector 290. Thus, when banknote P101 comes in, it cannot possibly be crushed on the tip of separator 236.

Figure 15:
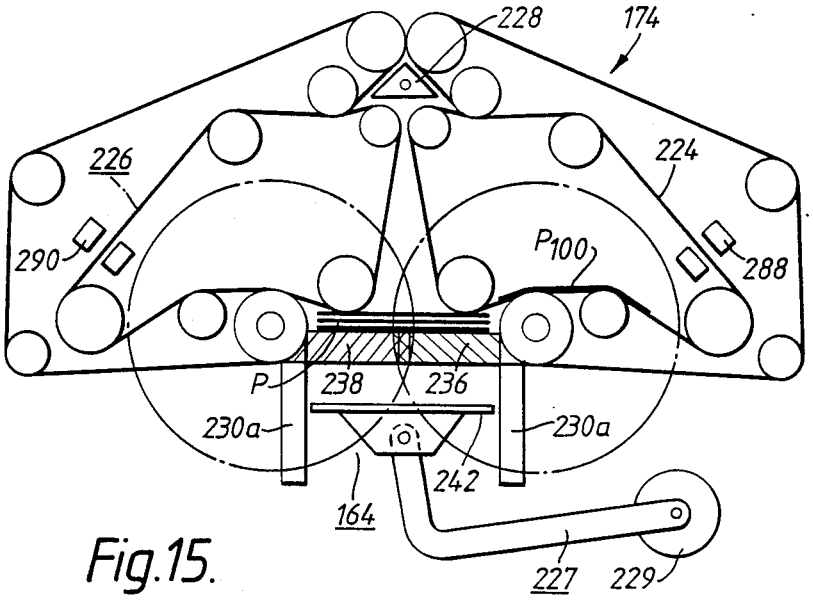

Then, as shown in FIG. 15, at the time when banknote P101 has completely entered, pulse motor 260 or 262 drives the separator upward. Thus, separators 236 and 238 maintain a stable collection state.

This state continues until the specified number of banknotes P collected in collecting chamber 168 is transferred on to carrier 171, as shown in FIG. 14, by the downward movement of receiving platform 242 of back-up mechanism 228, and receiving platform 242 has returned into collecting chamber 168, as shown in FIG. 15.

When receiving platform 242 returns to the specified position, as shown in FIG. 15, separators 236 and 238 start to rotate and return to their initial positions, as shown FIG. 16. By this action, banknotes P which have been stored by the separators are transferred to receiving platform 242.

Incidentally, the device is designed so that the radii of the tips of the two separators 236 and 238 intersect and, when supporting banknote P, there is no gap in the center of separators 236 and 238 into which a banknote P can enter.

Moreover, as shown in FIG. 18, in order to make the orbit 300 of the rotating tip of separator 236 as parallel as possible to convey path 224, and to make the period during which the tip of separator 236 is passing through convey path 234 shorter, the invention is designed as shown in detail in FIGS. 9 to 18, so that intermediate roller 202, is positioned between roller 200 and adjacent roller 188. Thus roller 202 becomes parallel to orbit 300 of separator 236. Incidentally, the reverse convey path side is similar to the obverse convey path side.

Also, by rotating separator 236 in the direction of the arrow showing the direction of passage of banknote P, the separator 236 can follow the trailing edge of banknote P100, which completes the designated number. Since the time during which separator 236 is following the trailing edge of banknote P during its passage along convey path 224 becomes an advantageous margin, it is possible to rotate separator 236 with a small power source because the movement of separator 236 can be delayed by that amount of time.

What is claimed is:

1. A collecting device for collecting sheets conveyed one by one along a predetermined convey path comprising:

means for detecting the side orientation of the conveyed sheet and for discriminating between the obverse and reverse side orientations;

obverse sheet convey means for conveying the sheets which are discriminated by the discriminating means to have the obverse side orientation, the obverse sheet convey means having a first outlet;

reverse sheet convey means for conveying the sheets which are discriminated by the discriminating means to have the reverse side orientation, the reverse sheet convey means having a second outlet facing the first outlet;

means for guiding the sheet to one of the obverse sheet convey means and reverse sheet convey means in response to the detecting means;

means for collecting the sheets conveyed from both the obverse convey means and the reverse convey means;

means for receiving a predetermined plurality of the sheets collected by the collecting means; and first and second individually movable separating means for interrupting during a predetermined time the passage of sheets between the first and second outlets and the collecting means so that the predetermined plurality of sheets collected in the collecting means can be conveyed to the receiving means, the first separating means and second separating means interacting to support sheets conveyed from the first and second outlets during the predetermined time while the predetermined plurality of sheets are conveyed to the receiving means;

each of the first and second separating means including a plurality of support arms and a rotatable shaft, a first end of each of the plurality of arms being fixed to the corresponding rotatable shaft and a second end of each of the plurality of arms extending in opposing relation toward one another with a portion of each arm extending in overlapping intermeshed relation to a portion of each opposing arm.

2. The device as recited in claim 1, wherein the rotatable shafts are disposed adjacent the first and second outlets.

3. The device as recited in claim 2, wherein the support arms rotate across the obverse and reverse convey means.

4. A collecting device for collecting sheets conveyed one by one along a predetermined convey path comprising:

means for detecting the side orientation of the conveyed sheet and for discriminating between obverse and reverse side orientations;

obverse sheet convey means for conveying the sheets which are discriminated by said discriminating means to have the obverse orientation, the obverse sheet convey means having a first outlet;

reverse sheet convey means for conveying the sheets which are discriminated by said discriminating means to have the reverse side orientation, the reverse sheet convey means having a second outlet facing the first outlet;

means for guiding the sheet to one of said obverse sheet convey means and reverse sheet convey means in response to the detecting means;

means for collecting the sheets conveyed from both the obverse sheet convey means and the reverse sheet convey means;

means for receiving a predetermined plurality of the sheets collected by the collecting means; and first and second individually movable separating means for interrupting the passage of sheets between the first and second outlets and the collecting means, the first and second separating means interacting to support sheets for a predetermined time;

each of the first and second separating means including a plurality of support arms and a rotatable shaft, a first end of each of said plurality of arms being fixed to the corresponding rotatable shaft and a second end of each of said plurality of arms extending in opposing relation toward one another with a portion of each arm extending in overlapping intermeshed relation to a portion of each opposing arm;

each of the rotatable shafts including rotating means for rotating said support arms between a neutral position and a primary support position, the primary support position being between one of the first and second outlets and the collecting means and wherein each of the rotating means is operable for rotating said support means to a secondary support position at specified intervals for facilitating the passage of a sheet from one of the first and second outlets on to the first and second separating means.

5. A collecting device for collecting sheets conveyed one by one along a predetermined convey path comprising:

means for detecting the side orientation of the conveyed sheet and for discriminating between the obverse and reverse side orientations;

obverse sheet convey means for conveying the sheets which are discriminated by the discriminating means to have the obverse side orientation, the obverse sheet convey means having a first outlet;

reverse sheet convey means for conveying the sheets which are discriminated by the discriminating means to have the reverse side orientation, the reverse sheet convey means having a second outlet facing the first outlet;

means for guiding the sheet to one of the obverse sheet convey means and reverse sheet convey means in response to the detecting means;

means for collecting the sheets conveyed from both the obverse convey means and the reverse convey means;

means for receiving a predetermined plurality of the sheets collected by the collecting means; and first and second individually movable separating means for interrupting during a predetermined time the passage of sheets between the first and second outlets and the collecting means so that the predetermined plurality of sheets collected in the collecting means can be conveyed to the receiving means, the first separating means and the second separating means interacting to support sheets conveyed from the first and second outlets during the predetermined time while the predetermined plurality of sheets are conveyed to the receiving means;

each of the first and second separating means including at least one support arm having first and second opposite ends and a rotatable shaft, the first end of each of the support arms being fixed to the corresponding rotatable shaft and the second end of each of the support arms extending in opposing relation toward one another with a portion of each arm extending in overlapping intermeshed relation to a portion of each opposing arm, each of the rotatable shafts including means for rotating the support arms between a neutral position and a primary support position, the primary support position being between one of the first and second outlets and the collecting means.

* * * * *